US007500900B2

(12) United States Patent
Wolfe, Jr. et al.

(10) Patent No.: US 7,500,900 B2
(45) Date of Patent: Mar. 10, 2009

(54) FLYING DISC

(75) Inventors: Jerry Joe Wolfe, Jr., Sarasota, FL (US); Harold Keith Benson, Hutto, TX (US); Robert Troy Dunn, Hutto, TX (US); Jessy B. Gabriel, Hutto, TX (US); David J. Kroyer, Hutto, TX (US)

(73) Assignee: Triple Crown Dog Academy, Inc., Hutto, TX (US)

( * ) Notice: Subject to any disclaimer, the term of this patent is extended or adjusted under 35 U.S.C. 154(b) by 134 days.

(21) Appl. No.: 10/756,691

(22) Filed: Jan. 13, 2004

(65) Prior Publication Data

US 2005/0153628 A1 Jul. 14, 2005

(51) Int. Cl.
*A63H 17/36* (2006.01)

(52) U.S. Cl. ..... 446/460

(58) Field of Classification Search ..... 446/46, 446/47, 48; 473/588; 119/707; 224/23 C, 224/23 R, 12.2; D21/301
See application file for complete search history.

(56) References Cited

U.S. PATENT DOCUMENTS

| | | | | | |
|---|---|---|---|---|---|
| D027,879 | S | | 11/1897 | Henderson | |
| 3,362,575 | A | * | 1/1968 | Fotos | 206/508 |
| 3,384,265 | A | * | 5/1968 | Frank | 206/508 |
| 3,724,122 | A | | 4/1973 | Gillespie | |
| 3,765,122 | A | * | 10/1973 | English | 446/48 |
| 3,883,036 | A | * | 5/1975 | Mahaffy et al. | 220/781 |
| 4,023,805 | A | * | 5/1977 | Sherrill | 473/588 |
| 4,153,252 | A | * | 5/1979 | Sullivan | 473/588 |
| 4,194,645 | A | * | 3/1980 | Zabner et al. | 220/781 |
| 4,212,131 | A | | 7/1980 | Ross, Jr. | |
| 4,253,269 | A | * | 3/1981 | Sullivan | 446/46 |
| D260,492 | S | * | 9/1981 | Scott | D9/452 |
| 4,302,901 | A | * | 12/1981 | Psyras | 446/46 |
| 4,421,244 | A | * | 12/1983 | Van Melle | 220/781 |
| 4,560,358 | A | * | 12/1985 | Adler | 446/46 |
| 4,568,297 | A | | 2/1986 | Dunipace | |
| 4,669,996 | A | * | 6/1987 | Bershak | 446/48 |
| D303,633 | S | * | 9/1989 | Terauds | D9/428 |
| 4,938,486 | A | * | 7/1990 | Graf | 473/588 |
| 5,366,403 | A | * | 11/1994 | Weiss | 446/46 |
| 5,427,266 | A | * | 6/1995 | Yun | 220/377 |
| 5,531,624 | A | * | 7/1996 | Dunipace | 446/46 |
| D381,267 | S | * | 7/1997 | Rush et al. | D9/452 |
| D381,268 | S | * | 7/1997 | Rush et al. | D9/452 |
| D386,222 | S | | 11/1997 | Dunipace | |
| 5,791,509 | A | * | 8/1998 | Rush et al. | 220/781 |
| D401,289 | S | | 11/1998 | Dunipace | |
| D433,721 | S | * | 11/2000 | Rojas et al. | D21/681 |
| 6,179,737 | B1 | * | 1/2001 | Adler | 473/588 |
| 6,247,989 | B1 | * | 6/2001 | Neff | 446/46 |
| 6,383,052 | B1 | | 5/2002 | McCarthy | |
| 6,554,674 | B1 | * | 4/2003 | Thorne, III | 446/46 |
| D474,517 | S | * | 5/2003 | Harms | D21/681 |
| 6,595,823 | B2 | * | 7/2003 | Huset | 446/46 |
| 7,264,135 | B2 | * | 9/2007 | Savicki et al. | 220/781 |
| 7,294,036 | B2 | * | 11/2007 | Potts | 446/46 |
| 2008/0064289 | A1 | * | 3/2008 | McAnulty | 446/46 |

* cited by examiner

*Primary Examiner*—Dana Ross
(74) *Attorney, Agent, or Firm*—Dillon & Yudell LLP; Brian F. Russell

(57) ABSTRACT

A flying disc has a radially symmetric form having an upper surface and a lower surface. The upper surface includes a raised central portion, a flat annular ring encompassing the raised central portion, and a raised rim extending above and encompassing the flat annular ring. A maximum height of the central raised portion above the flat annular ring is no greater than a height of the raised rim.

40 Claims, 1 Drawing Sheet

FLYING DISC

BACKGROUND OF THE INVENTION

1. Technical Field

The present invention relates to flying discs.

2. Description of the Related Art

Hand thrown flying toys, and in particular flying discs, continue to be some of the most popular recreational toys. Specialty discs having different flight characteristics, weights, and materials are now being developed for particular segments of the disc market. For example, specialty discs are now being designed and marketed for Ultimate FRISBEE®, disc golf, recreational catching, distance throwing, and canine disc sports.

As set forth in U.S. Pat. No. 5,531,624 to Dunipace, disc designs are commonly evaluated based upon multiple criteria including: (1) throwability—how easily the disc is gripped and released, (2) flight characteristics—flight path, ballistics, freedom from roll, resistance to flight path deflection by wind, etc., and (3) durability. Many disc designs attain commercially acceptable throwability, flight characteristics, and durability for their intended use through the use of high density, semi-rigid materials (e.g., plastics) and low profiles. A combination of these features yields discs of acceptable durability that tend to fly far and fast and are at least somewhat resistant to flight path deflection by wind.

The present inventors recognize, however, that a high velocity, low-profile flying disc formed of high density, semi-rigid plastic can be painful and/or difficult to catch for both humans and canines. That is, a human user may find that a conventional flying disc flies to fast and too far to catch easily, and that when caught, impacts the hand with a painful sting. In addition, a dog catching a conventional flying disc formed of semi-rigid plastic (e.g., polyethylene or polypropylene) can sustain significant impact on its teeth and gums, resulting in bleeding gums and loosened teeth. Moreover, even after short periods of use, the dog's teeth may puncture or mar the disc surface, resulting in sharp burs that may further injure the mouth of a canine catcher. The flying disc may also travel too far or too fast for a dog to be able to successfully catch an acceptably high percentage of throws. The pain, injury and frustration attendant to the use of conventional semi-rigid flying discs can thus discourage their use, diminishing their recreational utility.

Despite such drawbacks to the use of high density semi-rigid materials for flying discs, particularly for discs intended for use by novice users and canines, flying discs formed of semi-rigid materials continue to dominate the market because flying discs formed of more flexible materials have heretofore exhibited unacceptable flight characteristics and/or durability.

SUMMARY OF THE INVENTION

In view of the foregoing shortcomings of conventional flying discs, the present invention provides an improved flying disc that is suitable for use by novice users or in canine disc sports.

According to one embodiment, a flying disc has a radially symmetric form having an upper surface and a lower surface. The upper surface includes a raised central portion, a flat annular ring encompassing the raised central portion, and a raised rim extending above and encompassing the flat annular ring. A maximum height of the central raised portion above the flat annular ring is no greater than a height of the raised rim.

In another embodiment, a flying disc has a radially symmetric form having an upper surface and a lower surface. The upper surface includes a raised central portion, a lower intermediate surface, and a raised rim extending above and encompassing the lower intermediate surface. The raised rim includes a sloped inner sidewall having a flat profile, a sloped outer sidewall having a flat profile, and a flat rim top intermediate the sloped inner sidewall and the sloped outer sidewall. The sloped inner sidewall has a greatest height at its outermost extent, and the sloped outer sidewall has a greatest height at its innermost extent. A maximum height of the central raised portion is no greater than a height of the raised rim.

In still another embodiment, a flying disc includes a radially symmetric form having an upper surface and a lower surface, and the upper surface includes a raised central portion, a lower intermediate surface, and a raised rim extending above and encompassing the lower intermediate surface. The maximum height of the central raised portion is no greater than a height of the raised rim. The lower surface has a central generally concave portion encompassed by a flat annular ring corresponding to a location of the lower intermediate surface on the upper surface, an annular fillet curve encompassing the flat annular ring, and a rim foot encompassing the fillet curve.

All objects, features, and advantages of the present invention will become apparent in the following detailed written description.

BRIEF DESCRIPTION OF THE DRAWINGS

The novel features believed characteristic of the invention are set forth in the appended claims. However, the invention, as well as a preferred mode of use, will best be understood by reference to the following detailed description of an illustrative embodiment when read in conjunction with the accompanying drawings, wherein:

DETAILED DESCRIPTION OF ILLUSTRATIVE EMBODIMENT

Figure 1:
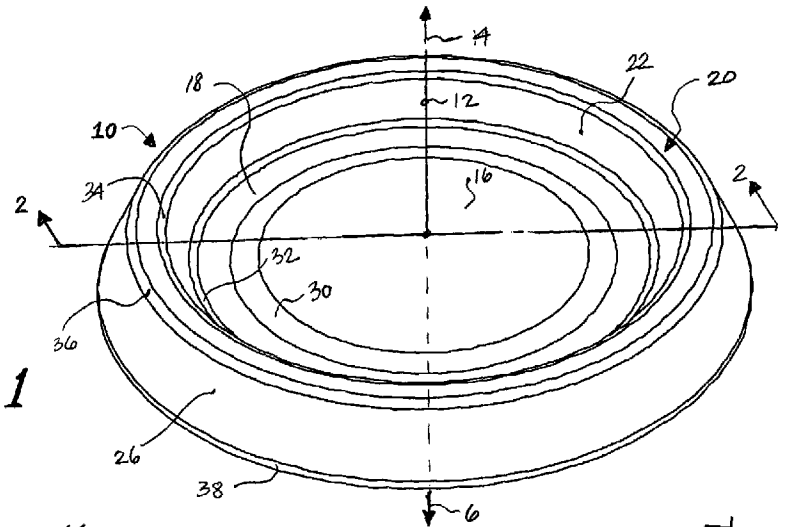
FIG. 1 is an isometric view of an exemplary embodiment of a flying disc in accordance with the present invention.

With reference now to the figures, and in particular with reference to FIG. 1, there is illustrated an isometric view of an exemplary embodiment of a flying disc 10 in accordance with the present invention. As shown, the exemplary embodiment of flying disc 10 is radially symmetric about a central vertical axis 12, and is circular when viewed in plan along central vertical axis 12. In the following description and claims, terms such as "upper" or "above", "lower" or "beneath", "inward" or "inner", "outer" or "outward" or the like are employed to describe flying disc 10. As utilized herein, these terms describe relative directions when flying disc 10 is observed in a horizontal, upright orientation such as illustrated in figures. In other words, flying disc 10 is described relative to a conventional coordinate system centered on central vertical axis 12. As a further clarification, the term "inward" or "inner" is defined herein to mean radially toward central vertical axis 12, "outward" or "outer" is defined herein to mean radially away from central vertical axis 12, and "upper" and "lower" are defined herein to mean axially along central vertical axis 12 in the directions of arrows 4 and 6, respectively.

Figure 2:
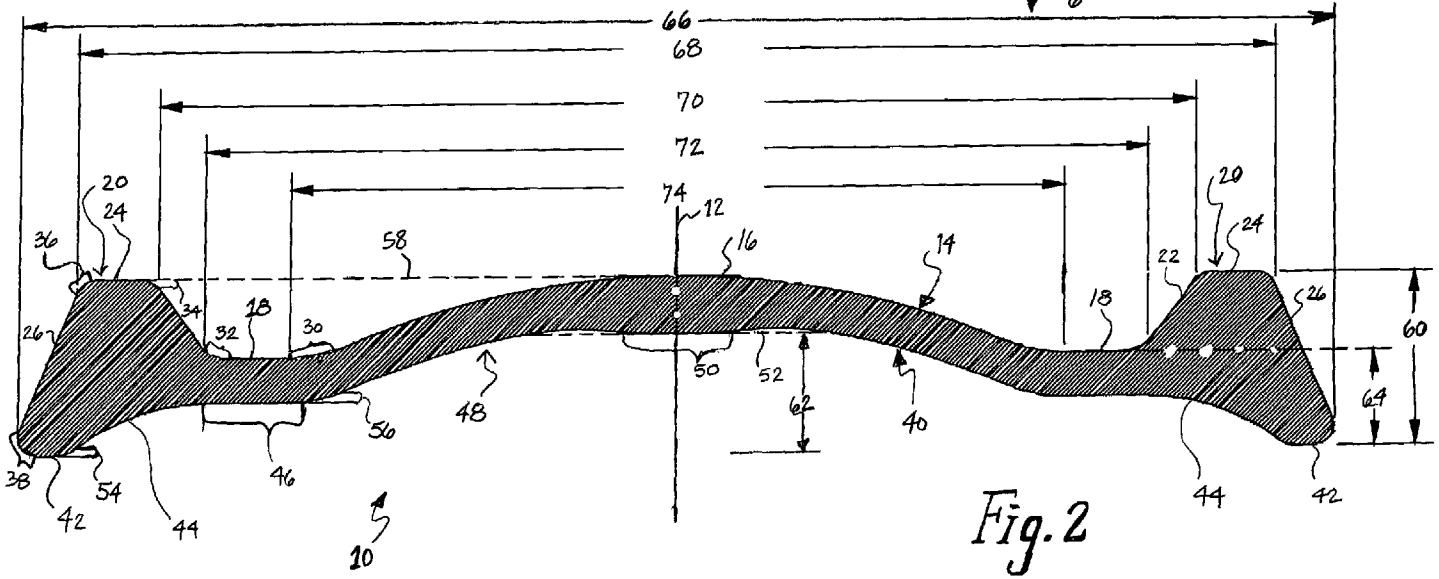
FIG. 2 is a section view of the flying disc of FIG. 1 taken along the line 2-2.

Still referring to FIG. 1 and additionally referring to FIG. 2, which depicts flying disc 10 in a scaled section taken along line 2-2 of FIG. 1, flying disc 10 has an upper surface 14 and a lower surface 40. Upper surface 14 includes a raised central portion 16, which in the depicted embodiment takes the form of a convex dome; a flat annular ring 18 encompassing raised central portion 16; and a raised rim 20 encompassing flat annular ring 18. Raised rim 20 in turn has three principal subsurfaces: an inwardly facing sidewall 22, a rim top 24, and an outwardly facing sidewall 26. As best seen in FIG. 2, each of surfaces 22, 24, and 26 preferably has a substantially flat profile in section. In addition, the plane including rim top 24 is parallel to the plane including flat annular ring 18, both of which are orthogonal to central vertical axis 12. It should further be noted that to improve aerodynamics, each of the principal subsurfaces of upper surface 14 is joined to an adjacent subsurface by a respective one of a number of small interstitial annular curved surfaces 30, 32, 34, 36, and 38.

As further depicted in FIG. 2, lower surface 40 includes four principal subsurfaces. These subsurfaces include substantially concave central portion 48, a flat annular ring 46 encompassing raised central portion 48, an annular fillet curve 44 encompassing flat annular ring 46, and rim foot 42. As can be seen by reference to line 52, the depicted embodiment of substantially concave central portion 48 includes a convex region 50 to facilitate release of flying disc 10 from a mold in which it is formed. Similarly to upper surface 14, lower surface 40 also includes a small interstitial annular curved surface 54 joining rim foot 42 and fillet curve 44, and a small interstitial annular curved surface 56 joining flat annular ring 46 and substantially concave central portion 48. Flat annular ring 46 and fillet curve 44 directly abut without any intermediate surface.

Flying disc 10 is characterized by excellent throwability. That is, when gripping and throwing flying disc 10, the thumb of a human user naturally rests on rim top 24, and the hand and fingers curl around outwardly facing sidewall 26 and rim foot 42, causing the fingertips to rest against fillet curve 44. When released from this comfortable hand position, level, stable flight of flying disc 10 is promoted. The grip and tactile feel of flying disc 10 can be further enhanced by the addition of texture on fillet curve 44.

The flight characteristics of an embodiment of flying disc 10 depend heavily on the aerodynamics imparted by the interrelationships of the various component subsurfaces of both upper surface 14 and lower surface 40. As is typical of flying objects, even small modifications to the relationships between surfaces yields significant changes to flight characteristics. In an embodiment in which flying disc 10 is suitable for canine disc sports (and for human use), it is preferred for flying disc 10 to be highly stable in flight, resisting both roll (i.e., tilting to the left or right) and pitch (i.e., tilting forward or backward). Moreover, it is preferred if flying disc 10 maintains these characteristics, even during low speed flight, for example, at the end of flight. In this manner, the probability of a successful catch by a dog is substantially increased.

In order to achieve these desirable flight characteristics, the following combination of surface and dimensional relationships is presently preferred:

(1) width of rim foot 42 is less than that of rim top 24 and of flat annular ring 18, and width of flat annular ring 18 is greater than or equal to that of rim top 24;

(2) substantially concave central portion 48 on lower surface 40 generally corresponds in location to raised central portion 16 on top surface 14, and flat annular ring 46 on lower surface 40 is in a plane parallel to and generally corresponds in location to flat annular ring 18 on upper surface 14;

(3) an overall height 60 of rim top 24 above rim foot 42 is substantially the same or greater than the maximum height of raised central portion 14 above rim foot 42, as indicated by line 58;

(4) the diameter of flying disc 10 generally increases between rim top 24 and rim foot 42 because of inward slope of outwardly facing sidewall 26;

(5) the maximum clearance 62 of raised central portion 48 above rim foot 42 is greater than the minimum height 64 of upper surface 14 above rim foot 42 at flat annular ring 18;

(6) the minimum height 64 is preferably between 50% and 60% of overall height 60 and, more particularly, is approximately 54% of overall height 60; and (7) the overall height 60 is preferably between 10% and 15% of the maximum diameter 66 and, more particularly, is about 13% of maximum diameter 66.

As will be appreciated, not all of these features are required in every embodiment of the present invention. However, experimental testing indicates that the more of these features are present, the better the flight characteristics that are achieved.

Although the above surface and dimensional relationships can be expressed in a range of implementations, representative dimensions of one specific implementation of a flying disc 10 in accordance with the present invention are given in Table I below:

TABLE I

| | |
|---|---|
| outer diameter 66 | 9.17 inches |
| first intermediate diameter 68 spanning upper ends of outwardly facing sidewalls 26 | 8.37 inches |
| second intermediate diameter 70 spanning upper ends of inwardly facing sidewalls 22 | 7.25 inches |
| third intermediate diameter 72 spanning lower ends of inwardly facing sidewalls 22 | 6.59 inches |
| fourth intermediate diameter 74 spanning inner diameter of flat annular ring 18 | 5.42 inches |
| overall height 60 | 1.20 inches |
| upper surface minimum height 64 | 0.65 inches |
| clearance above rim foot 42 at central vertical axis 12 | 0.80 inches |
| thickness at central vertical axis 12 | 0.40 inches |

To provide a flying disc 10 of acceptable durability while addressing the shortcomings discussed above of discs formed of semi-rigid plastic discs, it is presently preferred that flying disc 10 be molded as a unitary piece of durable non-memory foam. Although a variety of foam densities may be employed in the manufacture of flying disc 12, it is presently preferred if the foam has a density of between about 9.50 and 12.00 pounds per cubic foot (pcf). Given the exemplary dimensions above, a density of 10.88 pcf will yield a flying disc 10 of approximately 100 g, which is the official weight of many canine disc sports.

As will be appreciated, a flying disc 10 of all non-memory foam construction absorbs the impact shock of catching by deforming, and then immediately returns to its original shape. Consequently, the likelihood that a human or canine or human user will experience pain and/or injury resulting from the impact of flying disc 10 is significantly diminished. In addition, as flying disc 10 wears, for example, due to biting by a dog, no harmful burs will be formed that will cut or abrade the hand of a human user or mouth of a dog.

Although in many embodiments it is preferred if flying disc 10 is formed from foam, it will be appreciated by those skilled in the art that, in other embodiments, flying disc 10 may alternatively be formed of a semi-rigid plastic, such as polyethylene.

While the invention has been particularly shown as described with reference to a preferred embodiment, it will be understood by those skilled in the art that various changes in form and detail may be made therein without departing from the spirit and scope of the invention. Accordingly, the foregoing description is not to be taken as limiting the scope of the invention, which is defined by the appended claims.

What is claimed is:

1. A flying disc, comprising:

a radially symmetric form suitable for rotational flight when thrown by a human, said radially symmetric form having an upper surface and a lower surface;

the upper surface including a raised central portion, a flat annular ring encompassing the raised central portion, and a raised rim extending above and encompassing the flat annular ring, wherein said raised central portion comprises a raised central dome that curves along a maximum diameter of the flying disc;

wherein a maximum height above said flat annular ring of all portions of the flying disc encompassed by the flat annular ring is no greater than a height of the raised rim; and wherein the raised rim includes a rim top, and wherein a first thickness of the flying disc measured orthogonally to the rim top is greater than a second thickness of the flying disc measured orthogonally to the flat annular ring.

2. The flying disc of claim 1, wherein the flying disc weighs approximately 100 g.

3. The flying disc of claim 1, wherein an overall height of the flying disc is between 10% and 15% of an overall diameter of the flying disc.

4. The flying disc of claim 1, wherein the flying disc has an overall diameter of approximately 9 inches.

5. The flying disc of claim 1, wherein raised rim includes a rim top and a sloped inner sidewall extending substantially between said flat annular ring and said rim top, wherein the sloped inner sidewall has a flat profile over substantially its entire extent.

6. A flying disc, comprising:

a radially symmetric form suitable for rotational flight when thrown by a human, said radially symmetric form having an upper surface and a lower surface;

the upper surface including a raised central portion, a flat annular ring encompassing the raised central portion, and a raised rim extending above and encompassing the flat annular ring;

wherein a maximum height above said flat annular ring of all portions of the flying disc encompassed by the flat annular ring is no greater than a height of the raised rim;

wherein said raised rim includes:

a sloped inner sidewall having a flat profile, said sloped inner sidewall having a greatest height at its outermost extent;

a sloped outer sidewall having a flat profile, said sloped outer sidewall having a greatest height at its innermost extent; and a rim top intermediate said sloped inner sidewall and said sloped outer sidewall, said rim top having a flat profile;

wherein said sloped inner sidewall extends substantially between said flat annular ring and said rim top and has said flat profile over substantially its entire extent; and wherein a first thickness of the flying disc measured orthogonally to the rim top is greater than a second thickness of the flying disc measured orthogonally to the flat annular ring.

7. The flying disc of claim 6, wherein the flying disc weighs approximately 100 g.

8. The flying disc of claim 6, wherein an overall height of the flying disc is between 10% and 15% of an overall diameter of the flying disc.

9. The flying disc of claim 6, wherein the flying disc has an overall diameter of approximately 9 inches.

10. A flying disc, comprising:

a radially symmetric form suitable for rotational flight when thrown by a human, said radially symmetric form having an upper surface and a lower surface;

the upper surface including a raised central portion, a first flat annular ring encompassing the raised central portion, and a raised rim extending above and encompassing the flat annular ring;

wherein a maximum height above said first flat annular ring of all portions of the flying disc encompassed by the first flat annular ring is no greater than a height of the raised rim;

wherein the lower surface includes:

a central generally concave portion;

a second flat annular ring corresponding to a location of said first flat annular ring on the upper surface and encompassing the central generally concave portion;

an annular fillet curve encompassing the second flat annular ring of the lower surface; and a rim foot encompassing said annular fillet curve, wherein the annular fillet curve extends substantially between the second flat annular ring and the rim foot; and wherein the raised rim includes a rim top, and wherein a first thickness of the flying disc measured orthogonally to the rim top is greater than a second thickness of the flying disc measured orthogonally to the first flat annular ring.

11. The flying disc of claim 10, wherein the flying disc weighs approximately 100 g.

12. The flying disc of claim 10, wherein an overall height of the flying disc is between 10% and 15% of an overall diameter of the flying disc.

13. The flying disc of claim 10, wherein the flying disc has an overall diameter of approximately 9 inches.

14. The flying disc of claim 10, wherein raised rim includes a rim top and a sloped inner sidewall extending substantially between said flat annular ring and said rim top, wherein the sloped inner sidewall has a flat profile over substantially its entire extent.

15. A flying disc, comprising:

a radially symmetric form suitable for rotational flight when thrown by a human, said radially symmetric form having an upper surface and a lower surface;

the upper surface including a raised central portion, a lower intermediate surface, and a raised rim extending above and encompassing the lower intermediate surface, wherein said raised rim includes:

a sloped inner sidewall having a flat profile, said sloped inner sidewall having a greatest height at its outermost extent;

a sloped outer sidewall having a flat profile, said sloped outer sidewall having a greatest height at its innermost extent;

a rim top intermediate said sloped inner sidewall and said sloped outer sidewall, said rim top having a flat profile;

wherein a maximum height of all portions of the flying disc is no greater than a height of the raised rim and said sloped inner sidewall extends substantially between said lower intermediate surface and said rim top and has said flat profile over substantially its entire extent; and wherein a first thickness of the flying disc measured orthogonally to the rim top is greater than a second thickness of the flying disc measured orthogonally to the lower intermediate surface.

16. The flying disc of claim 15, wherein said raised central portion comprises a raised central dome that curves along a maximum diameter of the flying disc.

17. The flying disc of claim 15, wherein said form comprises a unitary piece of foam.

18. The flying disc of claim 15, wherein said lower intermediate surface comprises a flat annular ring.

19. The flying disc of claim 18, wherein the flat annular ring lies in a plane orthogonal to a central axis about which the flying disc is radially symmetric.

20. The flying disc of claim 15, wherein the lower surface includes:

a central generally concave portion;

a flat annular ring corresponding to a location of said lower intermediate surface on the upper surface and encompassing the central generally concave portion;

an annular fillet curve encompassing the flat annular ring of the lower surface; and a rim foot encompassing said fillet curve, wherein the annular fillet curve extends substantially between the flat annular ring and the rim foot.

21. The flying disc of claim 15, wherein an overall height of the flying disc is between 10% and 15% of an overall diameter of the flying disc.

22. The flying disc of claim 15, wherein the flying disc weighs approximately 100 g.

23. The flying disc of claim 15, wherein the flying disc has an overall diameter of approximately 9 inches.

24. A flying disc, comprising:

a radially symmetric form suitable for rotational flight when thrown by a human, said radially symmetric form having an upper surface and a lower surface;

the upper surface including a raised central portion, a lower intermediate surface encompassing the raised central portion, and a raised rim extending above and encompassing the lower intermediate surface, wherein a maximum height of all portions of the flying disc encompassed by the lower intermediate surface is no greater than a height of the raised rim;

the lower surface including:

a central generally concave portion;

a flat annular ring corresponding to a location of said lower intermediate surface on the upper surface and encompassing the central generally concave portion;

an annular fillet curve encompassing the flat annular ring; and a rim foot encompassing said fillet curve, wherein the annular fillet curve extends substantially between the flat annular ring and the rim foot; and wherein the raised rim includes a rim top, and wherein a first thickness of the flying disc measured orthogonally to the rim top is greater than a second thickness of the flying disc measured orthogonally to the lower intermediate surface.

25. The flying disc of claim 24, wherein said raised central portion of said upper surface comprises a raised central dome that curves along a maximum diameter of the flying disc.

26. The flying disc of claim 24, wherein said form comprises a unitary piece of foam.

27. The flying disc of claim 24, wherein said rim foot is a lowest surface of the flying disc.

28. The flying disc of claim 24, wherein said lower intermediate surface comprises a flat annular ring.

29. The flying disc of claim 28, wherein the flat annular ring lies in a plane orthogonal to a central axis about which the flying disc is radially symmetric.

30. The flying disc of claim 24, wherein an overall height of the flying disc is between 10% and 15% of an overall diameter of the flying disc.

31. The flying disc of claim 24, wherein the flying disc weighs approximately 100 g.

32. The flying disc of claim 24, wherein the flying disc has an overall diameter of approximately 9 inches.

33. A flying disc, comprising:

a radially symmetric form suitable for rotational flight when thrown by a human, said radially symmetric form having an upper surface and a lower surface;

the upper surface including a raised central portion, a first flat annular ring encompassing the raised central portion, and a raised rim extending above and encompassing the first flat annular ring, wherein:

a maximum height above said first flat annular ring of all portions of the flying disc encompassed by the first flat annular ring is no greater than a height of the raised rim;

said raised rim includes:

a sloped inner sidewall having a flat profile, said sloped inner sidewall having a greatest height at its outermost extent;

a sloped outer sidewall having a flat profile, said sloped outer sidewall having a greatest height at its innermost extent;

a rim top intermediate said sloped inner sidewall and said sloped outer sidewall, said rim top having a flat profile; and the lower surface includes:

a central generally concave portion;

a second flat annular ring corresponding to a location of said first flat annular ring on the upper surface and encompassing the central generally concave portion;

an annular fillet curve encompassing the second flat annular ring; and a rim foot encompassing said annular fillet curve, wherein the annular fillet curve extends substantially between the second flat annular ring and the rim foot; and wherein a first thickness of the flying disc measured orthogonally to the rim top is greater than a second thickness of the flying disc measured orthogonally to the first flat annular ring.

34. The flying disc of claim 33, wherein said raised central portion comprises a raised central dome that curves along a maximum diameter of the flying disc.

35. The flying disc of claim 33, wherein said form comprises a unitary piece of foam.

36. The flying disc of claim 33, wherein an overall height of the flying disc is between 10% and 15% of an overall diameter of the flying disc.

37. The flying disc of claim 33, wherein the first and second flat annular rings are parallel to a plane orthogonal to a central axis about which the flying disc is radially symmetric.

38. The flying disc of claim 33, wherein the flying disc weighs approximately 100 g.

39. The flying disc of claim 33, wherein the flying disc has an overall diameter of approximately 9 inches.

40. A flying disc, comprising:

a solid, radially symmetric form suitable for rotational flight when thrown by a human, said radially symmetric form having an upper surface and a lower surface;

the upper surface including a raised central portion, a flat annular ring encompassing the raised central portion, and a raised rim extending above and encompassing the flat annular ring;

wherein a maximum height above said flat annular ring of all portions of the flying disc encompassed by the flat annular ring is no greater than a height of the raised rim; and wherein a first thickness of the flying disc measured orthogonally to the raised rim at its maximum height is greater than a second thickness of the flying disc measured orthogonally to a maximum height of the raised central portion.

* * * * *